US007299858B2

(12) United States Patent
Dierssen

(10) Patent No.: US 7,299,858 B2
(45) Date of Patent: Nov. 27, 2007

(54) METHOD FOR REDUCING POLLUTANT EMISSIONS IN FOUNDRY PRACTICE

(75) Inventor: Gustav Dierssen, Bad Homburg (DE)

(73) Assignee: Climarotec Gesellschaft Fuer Raumklimatische Spezialanlagen mbH, Bad Homburg (DE)

( * ) Notice: Subject to any disclaimer, the term of this patent is extended or adjusted under 35 U.S.C. 154(b) by 0 days.

(21) Appl. No.: 11/591,035

(22) Filed: Oct. 31, 2006

(65) Prior Publication Data

US 2007/0102137 A1 May 10, 2007

Related U.S. Application Data

(63) Continuation of application No. 10/486,772, filed as application No. PCT/EP02/09078 on Aug. 13, 2002, now abandoned.

(30) Foreign Application Priority Data

Aug. 14, 2001 (DE) ..... 101 39 801

(51) Int. Cl.
*B22C 1/00* (2006.01)
*B22C 9/00* (2006.01)

(52) U.S. Cl. ..... 164/520; 164/349; 164/410

(58) Field of Classification Search ..... 164/5, 164/520, 410, 349
See application file for complete search history.

(56) References Cited

U.S. PATENT DOCUMENTS 4,266,595 A * 5/1981 Perkey et al. ..... 164/520
4,711,289 A * 12/1987 Kanoh et al. ..... 164/34

FOREIGN PATENT DOCUMENTS

| | | |
|---|---|---|
| CH | 442628 | 8/1967 |
| DE | 2916911 | 10/1980 |
| DE | 3246324 | 7/1984 |
| DE | 3707581 | 9/1987 |
| DE | 4226327 | 5/1993 |
| DE | 4327292 | 2/1995 |
| DE | 4327396 | 2/1995 |

* cited by examiner

*Primary Examiner*—Kevin P. Kerns
(74) *Attorney, Agent, or Firm*—Lipsitz & McAllister, LLC

(57) ABSTRACT

A method for reducing pollutant emissions from a metal casting case used in foundry practice. The metal casting case includes at least a molding material formed to a metal casting mold. The pollutant emissions are released from material making up the casting cases after pouring molten metal in the metal casting mold. The method includes the steps of adding at least one additional combustible substance to at least one region of the casting mold located outside of a contact region of the casting mold with the casting, and burning the at least one additional combustible substance in one of a gaseous and vaporized state together with the pollutant emissions.

21 Claims, 3 Drawing Sheets

METHOD FOR REDUCING POLLUTANT EMISSIONS IN FOUNDRY PRACTICE

This application is a continuation of U.S. application Ser. No. 10/486,772 filed Jul. 6, 2004 now abandoned, which is a U.S. National Stage Filing of International PCT Application No. PCT/EP02/09078 filed Aug. 13, 2002, which claims priority of German application no. 101 39 801.8 filed Aug. 14, 2001.

BACKGROUND OF THE INVENTION

The invention concerns a method for reducing pollution emissions, especially emissions of pyrolysis products, from the metal casting cases used in foundry practice. The invention also concerns metal casting cases for carrying out the method of the invention.

In metal foundries, emissions from metal casting molds are a significant source of odors as well as pollutants that may have important consequences to human health and the environment. The high temperatures required in metal casting cause large numbers of mainly organic substances in the form of pyrolysis products to be released from the metal casting molds or flasks. These products arise chiefly by thermal decomposition of the core mold material and of the additives used in the molding sand in metal casting The decomposed and volatilized compounds escape as noncombusted hydrocarbons, gases, aerosols, smoke, or dust.

The pollutant emissions arising during metal casting are released mainly in the casting line itself as well as in the cooling line and at the shakeout station, in other words, starting directly with the operation of pouring the molten metal. When metal casting cases are used, the pollutants escape, for example, through the fitting edge of the two halves of the casting mold. Additional release of a relatively large amount of emissions occurs during removal of the hot casting from the metal casting mold (shakeout station).

Occasionally, accidental combustion of the escaping emissions occurs or combustion is initiated by a pilot flame. However, this combustion occurs only if the local concentration, temperature, and calorific value of the emissions will allow this to occur.

Improved mold materials were developed to reduce the existing emissions load. Furthermore, legal emissions requirements were complied with by exhaust gas purification, for example, by expensive filtration systems, scrubbers, and biofilters. These systems have the disadvantage of high material and maintenance expenses. Moreover, the efficiency of these kinds of systems often fails to meet statutory requirements.

For example, DE 43 27 396 A1 describes direct exhausting of the pyrolysis products that are released in a casting operation and that form the pollutant emissions, collecting them in a collecting tank maintained at a negative pressure, and mixing them with secondary air, and then passing the exhaust air that has been diluted in this way through a separation stage before releasing it into the open atmosphere. A system of this type for catching, exhausting, and separating pyrolysis products is complicated and thus expensive.

Pyrolysis products that are a source of odors and of pollutants that are harmful to human health and the environment are also produced with the use of investment patterns made of vaporizable foam (CH 442 628 and DE 37 07 581 C2), since this mold material can be vaporized only "practically" residue-free, and, in addition, the gases formed during the pouring of the molten charge are drawn off through degassing channels and released into the atmosphere Environmental protection and humanization of the workplace are also becoming increasingly important in the foundry sector (DE 42 26 327 A1, DE 32 46 324 C2, and DE 43 27 292 C2). Further prior art methods are specified in U.S. Pat. No. 4,266,595.

SUMMARY OF THE INVENTION

Therefore, the objective of the invention is to refine the method mentioned at the beginning in such a way that effective reduction of pollutant emissions is achieved at low cost. In addition, it must be possible to use the method with all metal casting cases, regardless of the amount and composition of the emissions.

In accordance with the invention, this objective is achieved by modifications of the previously known methods. The invention is thus based on the idea of adding an additional combustible substance to ensure that the pollutants also burn. The common burning of the pollutants and the added combustible substance thus occurs almost independently of the amount and calorific value of the pollutants.

Metal casting molds generally consist of at least two parts, preferably two casting mold halves. At least one of these casting mold halves, preferably two casting mold halves, enclose the molding sand, which, for example, may be a porous sand material pressed with the use of additives and pressure. The shape of the molding sand determines the outer contour of the casting later produced. Optionally, one or more mold cores may be added to the casting space and then determine the inner contour and cavities of the casting.

Pollutant emissions are understood to mean gases, smoke, dusts, and/or aerosols that have foul odors or harmful health consequences.

The additional combustible substance to be used in accordance with the invention is understood to be an organic substance, which preferably contains a wax or an oil and more preferably a ketone, aldehyde, ether, alkane, or alcohol. Accordingly, this substance is a chemical compound that burns by autoignition or by pilot flame ignition when it leaves the flask in the gaseous state and comes into contact with the outside air. This substance is added to the metal casting case in addition to the additives customarily used in metal casting. A suitable combustible substance preferably has a high calorific value. Furthermore, preferred combustible substances for carrying out the method of the invention are those which burn or are highly inflammable or spontaneously ignite only in the presence of outside air. Combustible substances which, under the conditions of metal casting, burn by autoignition or by pilot flame ignition only after leaving the metal casting mold are especially preferred.

However, it is also possible to use a combustible gas (natural gas) as the combustible substance. The gas can be forced into the molding sand by injection pipes and can be controlled according to need. The use of gas is advantageous especially in the case of stationary molds, in other words, molds that are not produced on a conveyor, i.e., with no conveyance of the case.

The combustible substance added to the metal casting mold mixes in the gaseous state with the pollutants in the metal casting mold and escapes together with the pollutants. During the combustion of this mixture, the pollutants are burned by the heat of combustion of the additional combustible substance added in accordance with the invention. Accordingly, after being mixed with the combustible substance, the pollutants ultimately become only small admixtures within a combustible gas.

Therefore, this type of controlled combustion of pollutants with the addition of combustible substances is practically independent of the amount of pollutants, the pollutant composition, and the inherent calorific value or flammability of the pollutants in their given concentration at the given temperature.

The additional substance is preferably added to the pressed molding sand by adding it to the metal casting cases in the outer molding sand—in the region of the fitting edges of the casting mold halves.

It has been found to be very effective to introduce the additional combustible substance into at least one of the molding sand halves after the pressing and casting by means of injection and/or before pressing by mixing it with the molding sand or portions of the molding sand.

The use of a liquid combustible substance basically makes it possible to incorporate the substance in the interstices between the grains of molding sand and to distribute the substance by capillary forces.

The additional combustible substance can thus be added to the metal casting mold uniformly or concentrated in local regions. Depending on the design of the metal casting mold, the site at which the substance is added should be selected in such a. way that thorough mixing with the pollutants in the gas phase occurs, which can flow, for example, along crevices or along channels provided for this purpose in the molding sand or the outer casting mold itself. Direct contact of the additionally supplied combustible substance with the molten casting must be avoided, since this would produce a strong spontaneous pressure wave. The method of the invention also should not have any effect on existing, optimized molding techniques and/or materials. Therefore, the addition of the additional fuel only after the casting mold has been filled with the molten material has been found to be especially advantageous. This prevents the additional fuel in gaseous or liquid form from spreading to even a slight extent to the contact region of the casting. The movement of gas (away from the casting and towards the outside) that always occurs during the cooling process prevents the additional substance from exerting any influence.

This type of positioning of the additional combustible substance in the molding sand should be effected in such a way that the combustible substance mixes with the pollutants of the casting mold to ensure optimum combustion of the pollutant/substance mixture. It is advantageous to achieve optimum metering of the additional substance. Combustion of the pollutants that is optimized for the entire emission period can be achieved by controlling the amount/type of the substance, its local positioning, and the time at which it is added. It is especially advantageous to ensure that precisely the correct amount of additional combustible gas is emitted at all times, so that the escaping pollutants burn together with the gas in a permanent flame.

It was found to be especially advantageous for the common combustion of the pollutants and the added combustible substance to occur at the fitting edge of both casting mold halves, especially at an outlet orifice provided for this purpose in the fitting edge.

It is especially advantageous if at least one additional combustible substance is positioned in front of the fitting edge of the casting mold and/or in front of at least one outlet orifice of the casting mold, especially in the molding sand in front of the fitting edge of the casting mold and/or in front of at least one outlet orifice of the casting mold.

The amount of the combustible substance to be added depends on the dimensions, the design, and the composition of the given metal casting mold. The extent of the combustion of the released pollutants is determined not only by the positioning in the metal casting cases, but also by the amount of substance and the composition of the substance.

The additional combustible substance is preferably supplied to the casting mold at least in such an amount that combustion of the pollutants is guaranteed at least during part of the cooling phase of the casting process, preferably until the casting mold is opened, and more preferably until the casting is removed from the mold.

It is especially preferred to provide an additional fuel supplement, which guarantees complete combustion of all pollutants still incorporated in the molding stand by means of penetration of the entire molding material during the breaking open of the casting case to remove the casting. This results in combustion over the entire large surface of the opened molding sand. To accomplish this, a second addition/injection or repeated additions/injections of fuel into the casting mold can also be carried out.

Any compound or mixture of compounds that is combustible and ignitable under the conditions of a metal casting process may be used as the combustible substance. The expert is familiar with a large number of such compounds or mixtures, which have the required properties at the higher temperatures and ambient conditions in the metal casting case and/or at its fitting edge during their escape and contact with atmospheric air.

The additional combustible substances used in the method preferably contain at least one organic substance, preferably a wax or an oil, and especially a ketone, aldehyde, ether, alkane, or alcohol.

It is especially advantageous to use substances that are not decomposed by the small action of heat resulting from the positioning in accordance with the invention, but rather pass chemically unchanged into the gaseous state.

Preferably, combustible substances are used which have a boiling point between 20° C. and 200° C., preferably substances which have a boiling point between 50° C. and 100° C.

Naturally, substances that burn to form compounds that do not have strong odors and are safe from the standpoint of human health are preferred for carrying out the method of the invention. These are preferably gas mixtures that burn to form. carbon dioxide and water.

The added substances may exist, for example, in the solid state, but preferably they exist in the liquid state when added to the metal casting mold. It is especially advantageous for the substances to be present as liquids when added to the metal casting mold and to vaporize/boil when the hot metal or the hot exhaust gas emissions provide heat.

The conversion of the combustible substances to the gas phase is preferably brought about by heat build-up from the sides of the hot casting through the molding sand.

The heat which emanates from the cooling casting and spreads through the whole casting case reaches the combustible substance added in accordance with the invention during the steady temperature rise and converts it to the gas phase.

In accordance with an alternative embodiment of the method, the substance is evaporated by the hot pollutants formed during the casting process and burns, preferably only after it has formed a mixture with the pollutants, after leaving the casting mold and coming into contact with air. It is also possible for the substance/pollutant mixture to burn only after contact with a pilot flame.

Naturally, it is advantageous to produce thorough mixing of the pollutants with the additional substance. This is guaranteed by a sufficiently long mixing distance of the two gases with each other before they come into contact with the outside air.

The invention also concerns a metal casting case that is modified for carrying out the method of the invention. In this regard, it has been found to be especially favorable for the metal casting case to consist of at least two casting mold parts, such that at least one of the halves has a groove in the fitting edge as an outlet orifice for gases. It may also be advantageous to provide channels and holes in the molding sand to facilitate the escape of the gases.

Furthermore, it is very advantageous if gas lines that open into the outlet orifice are provided inside the molding sand.

In a further advantageous embodiment, at least one of the two casting mold halves has a recess in the molding sand for holding combustible substances.

The invention is explained below on the basis of examples shown in the drawings.

DETAILED DESCRIPTION OF THE INVENTION

Figure 1:
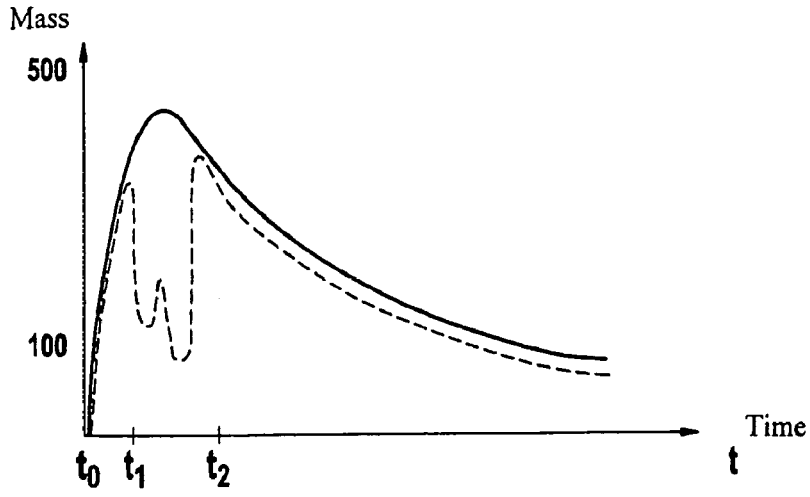
FIG. 1 shows pollution emissions as a function of time during the operation of a metal casting mold in accordance with the state of the art.
Figure 2:
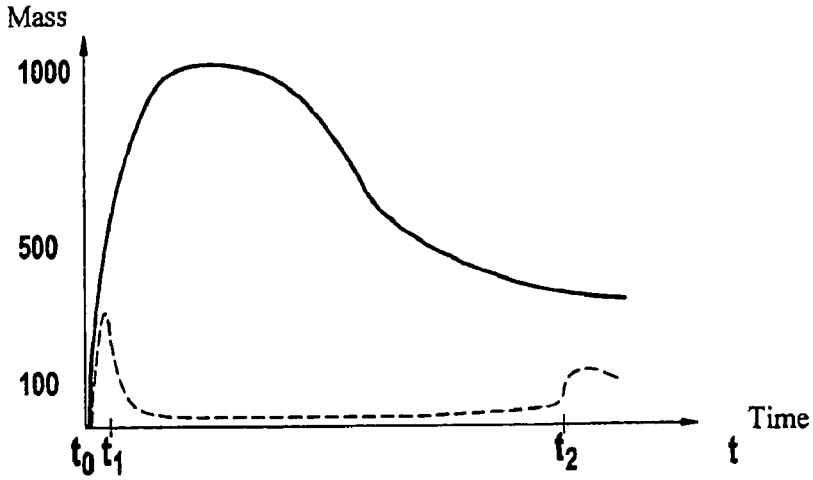
Prior Art Fig. 2
FIG. 2 shows pollution emissions as a function of time for a metal casting mold used for carrying out the method of the invention.

In FIGS. 1 and 2, the solid lines show the total mass of hydrocarbons leaving the flask.

The broken lines show the change as a function of time in the total weight of hydrocarbons in the exhaust air after brief mixing with the outside air and their partial combustion (FIG. 1) or complete combustion (FIG. 2). An example of a measurement point is indicated at point 8 in FIG. 3.

The y-axis shows the mass of the pollutants. Molten,metal is poured into the metal casting mold at time t0, and ignition of the pollutants is initiated at time t1. Combustion is completed at time t2, since the relatively small pollutant output no longer allows further combustion.

The integral of the area under the broken line is a measure of the still large amount of polluttants being emitted.

As FIG. 2 shows, the addition of a combustible substance raises the level of hydrocarbon emissions on the y-axis.

Molten iron is poured into the metal casting mold at time t0, and autoignition of the pollutant/substance mixture occurs at time t1. The combustion process ends at time t2, much later than in FIG. 1. The amount of additional combustible substance introduced has been almost completely consumed at this time.

The significant reduction of the area under the broken line shows the enormous effectiveness of the method of the invention. Despite the increased total emissions from the flask, the amount of pollutants ultimately released is significantly reduced. In particular, gas components with a strong odor and harmful health effects are burned and do not enter the environment.

Figure 3:
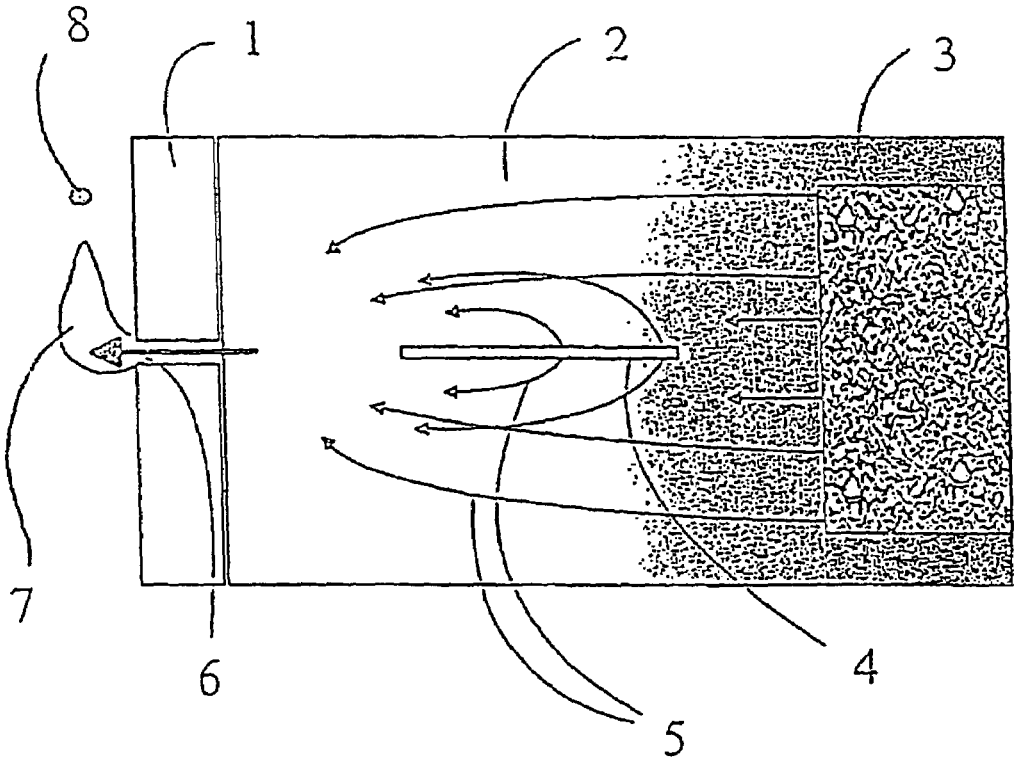
FIG. 3 shows a schematic vertical section of a flask part to illustrate the flow of the pollutants away from the casting mold and towards the fitting edge of the flask with the use of an additional fuel.

FIG. 3 shows a portion of a flask 1. The casting 3 lies in the molding sand 2. The more intense blackening in the area of the casting is an indication of the temperature development. The additional combustible substance 4 is located, for example, near a gas outlet (e.g., in the area of the fitting edge of the two halves of the flask 1). The illustrated flow lines 5 show that mixing of the vaporized fuel with the pollutant gases of the casting 3 is occurring. This gas mixture escapes to the outside in the region of the fitting edges of the two halves of the flask 1 in the direction of arrow 6 and reaches the point at which the total emissions shown in FIGS. 1 and 2 are present. The strong reduction of pollutants that is the goal of the invention is achieved by the combustion of the emerging gases in a common flame 7 in accordance with the invention. As mentioned earlier in connection with FIGS. 1 and 2, the measurement point 8 above the flame 7 shows a hypothetical measurement site for obtaining the broken lines shown in FIGS. 1 and 2.

Figure 4:
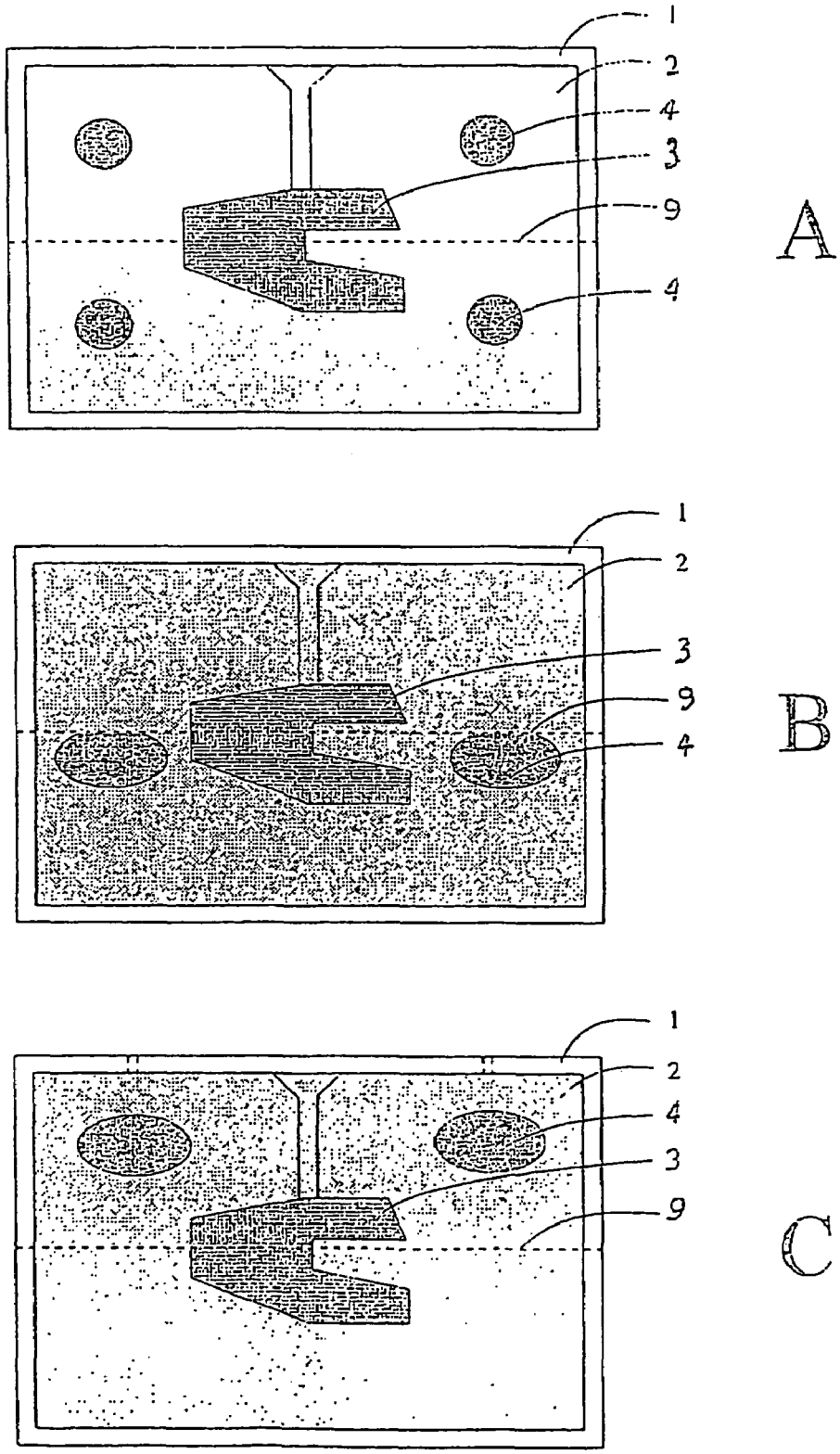
FIG. 4 shows three different possibilities A, B, and C for supplying combustible substances to the metal casting mold.

FIG. 4 shows examples of different possibilities for the addition of the combustible substance 4 in the flask 1. As FIG. 4 shows, the additional substance 4 is incorporated in partial regions of the molding sand 2, specifically, by injection or embedment before the assembly of the halves of the flask 1 on both sides of the dividing line 9 or by injection after casting.

In accordance with FIG. 4B the combustible substance 4 can be incorporated in only one half by pouring it in or embedding it in partial regions of the molding sand 2 before the assembly of the case halves.

Another possibility is shown in FIG. 4*c*, according to which the combustible substance 4 is incorporated in partial regions of the molding sand 2, specifically, by injection into the molding sand after casting.

As all three schematic drawings show, the additional combustible substance 4 is always incorporated separately from the casting 3, specifically, in such a way that it does not reach the surface of the casting. Regardless of which of the three incorporation possibilities is selected, the incorporation always guarantees that the substance is forced out of the mold only by heating and thus evaporation/boiling without decomposition, i.e., without the occurrence of pyrolysis.

In this regard, the substance can be incorporated in the molding case in such a way that, on being heated, it becomes distributed as a gas or vapor in high concentration. This achieves the goal of the substance emerging and burning together with the pollutants when the casting mold is opened (shakeout station).

The invention claimed is:

1. A method for reducing pollutant emissions released when molten metal is introduced into a metal casting mold used in foundry practice, comprising the steps of:

providing a molding material within said metal casting mold, said molding material having a contact region for a casting to be formed from molten metal introduced into the casting mold;

adding a combustible substance, in addition to any combustible substances that may already be in said molding material in the vicinity of the contact region, to at least one region of said casting mold located substantially outside of said contact region;

introducing molten metal into said casting mold for producing said casting; and burning said added combustible substance in one of a gaseous and vaporized state together with said pollutant emissions.

2. A method in accordance with claim 1, wherein said added combustible substance is converted in one of said gaseous state and said vapor state by heat.

3. A method in accordance with claim 2, wherein said heat is transferred from said molten metal to said at least one region via said molding material.

4. A method in accordance with claim 1, wherein the added combustible substance is introduced into the metal casting mold before pressing and mixing with at least a portion of the molding material.

5. A method in accordance with claim 1, wherein the additional combustible substance is embedded in a recess of the molding material.

6. A method in accordance with claim 1, wherein the added combustible substance is embedded in a recess of a core material of the metal casting mold.

7. A method for reducing pollutant emissions released when molten metal is introduced into a metal casting mold used in foundry practice, said method comprising the steps of:

providing a molding material within said metal casting mold, said molding material having a contact region for a casting to be formed from molten metal introduced into the casting mold;

adding at least one combustible substance, in addition to any combustible substances that may already be in said molding material in the vicinity of the contact region, to at least one region of said casting mold located substantially outside of said contact region, said combustible substance comprising a material adapted to be forced out of said at least one region only by heating and free of decomposition, and burning said at least one combustible substance in one of a gaseous and vaporized state together with said pollutant emissions.

8. A method in accordance with claim 7, wherein the combustible substance is a solid.

9. A method in accordance with claim 7, wherein the combustible substance is a liquid.

10. A method in accordance with claim 7, wherein the combustible substance contains at least one organic substance.

11. A method in accordance with claim 10, wherein the combustible substance contains at least one of:

a wax,
an oil,
a ketone,
an aldehyde,
an ether,
an alkane,
an alcohol.

12. A method in accordance with claim 7, wherein said combustible substance is added in one of a gaseous or vaporized state.

13. A method in accordance with claim 12, wherein said combustible substance contains at least one organic substance.

14. A method in accordance with claim 12, wherein said combustible substance is added after the casting mold has been filled with molten metal.

15. A method in accordance with claim 7, further comprising:

igniting a mixture of the pollutants and the combustible substance, at an outlet.

16. A method in accordance with claim 15, wherein the mixture is ignited at an outlet orifice provided at a fitting edge of the metal casting mold.

17. A method for reducing pollutant emissions released when molten metal is introduced into a metal casting mold used in foundry practice, said method comprising the steps of:

providing a molding material within said metal casting mold, said molding material having a contact region for a casting to be formed from molten metal introduced into the casting mold;

adding at least one combustible substance in one of a gaseous or vaporized state, in addition to any combustible substances that may already be in said molding material in the vicinity of the contact region, to at least one region of said casting mold located substantially outside of said contact region, and burning said at least one combustible substance together with said pollutant emissions.

18. A method in accordance with claim 17, wherein said combustible substance contains at least one organic substance.

19. A method in accordance with claim 17, wherein said combustible substance is added after the casting mold has been filled with molten metal.

20. A metal casting case comprising:

at least two casting mold parts formed from molding material, said casting mold parts forming a metal casting mold for a casting to be formed therein, a region in the molding material of at least one of the casting mold parts adapted to receive at least one combustible substance, in addition to any combustible substances that may already be in said molding material in the vicinity of said casting to be formed, wherein:

said at least one combustible substance is provided in said region, and said region is located separate from the casting to be formed and at a distance which prevents the at least one combustible substance provided in the region from contacting a surface of the casting.

21. A metal casting case comprising:

at least two casting mold parts formed from molding material, said casting mold parts forming a metal casting mold for a casting to be formed therein, a region in the molding material of at least one of the casting mold parts adapted to receive at least one combustible substance in addition to any combustible substances that may already be in said molding material in the vicinity of said casting to be formed, wherein:

said at least one combustible substance is provided in said region, and said region is located substantially separate from the casting to be formed at a distance which prevents the at least one combustible substance received in the region from contacting a surface of the casting, said at least one combustible substance comprising a material adapted to be forced out of said region only by heating and free of decomposition.

* * * * *